US012466631B2

(12) United States Patent
Brulz

(10) Patent No.: US 12,466,631 B2
(45) Date of Patent: Nov. 11, 2025

(54) RESEALABLE SUBSTANCE DISPENSING BAG

(71) Applicant: Daniel F Brulz, Waterford, WI (US)

(72) Inventor: Daniel F Brulz, Waterford, WI (US)

( * ) Notice: Subject to any disclaimer, the term of this patent is extended or adjusted under 35 U.S.C. 154(b) by 317 days.

(21) Appl. No.: 18/307,202

(22) Filed: Apr. 26, 2023

(65) Prior Publication Data

US 2024/0359900 A1 Oct. 31, 2024

(51) Int. Cl.
*B65D 33/25* (2006.01)
*B65D 33/24* (2006.01)
*B65D 83/06* (2006.01)

(52) U.S. Cl.
CPC ..... *B65D 83/06* (2013.01); *B65D 33/24* (2013.01)

(58) Field of Classification Search
CPC .... B65D 83/06; B65D 33/24; B65D 33/2508; B65D 33/01
See application file for complete search history.

(56) References Cited

U.S. PATENT DOCUMENTS 3,155,282 A 11/1964 Leblanc
3,388,836 A 6/1968 Otto et al.
3,510,054 A 5/1970 Sanni et al.
3,991,801 A * 11/1976 Ausnit ..... A45C 3/00 24/585.12
5,709,479 A 1/1998 Bell
5,882,120 A 3/1999 Bell
5,911,508 A * 6/1999 Dobreski ..... B65D 33/01 383/203
6,126,318 A 10/2000 Bell
6,375,037 B1 4/2002 Bell et al.
7,107,738 B2 9/2006 Ausnit et al.
7,416,336 B2 8/2008 Linton et al.
2003/0198407 A1* 10/2003 Rehwinkel ..... B65D 33/2508 383/203
2006/0210199 A1 9/2006 Ali
2007/0194042 A1 8/2007 Wilbur
2008/0164288 A1 7/2008 Singleton
2008/0240626 A1 10/2008 Bell
2008/0253696 A1 10/2008 Haas et al.
(Continued)

FOREIGN PATENT DOCUMENTS

CN 101374435 B * 7/2011 ..... B29C 65/76
EP 1621477 2/2006
(Continued)

OTHER PUBLICATIONS

Shaker Bag, Takigawa Corporation; 1 pg; 2023.
Terro Ant Killer Plus; 1 pg; 2022.

*Primary Examiner* — Bob Zadeh

(57) ABSTRACT

A resealable bag is produced with one or more apertures spanning a mouth of the bag, allowing egress of prefilled material from the bag. The prefilled material may be any material that is desired to be controllably dispersed, such as spices, seasonings, food products, fertilizer, seed, salt, etc. Different sizes of pouches and different sized apertures can be provided to accommodate preferred storage and dispensing of the selected material. In use, a user opens a zipper provided on an interior of the bag. The materials are held in the bag until the bag is inverted, and the material is dispersed from the bag through the apertures. Material egress can be enhanced by shaking the bag.

19 Claims, 6 Drawing Sheets

(56) References Cited

U.S. PATENT DOCUMENTS

| | | | | |
|---|---|---|---|---|
| 2009/0042707 | A1* | 2/2009 | Berich | B65D 33/2558<br>493/213 |
| 2009/0097786 | A1* | 4/2009 | Goglio | B65D 83/06<br>383/105 |
| 2010/0084425 | A1 | 4/2010 | Bell et al. | |
| 2011/0085747 | A1* | 4/2011 | Dais | B65D 81/2038<br>383/63 |
| 2018/0194528 | A1 | 7/2018 | Franca et al. | |
| 2019/0009950 | A1 | 1/2019 | Farstad et al. | |
| 2024/0359900 | A1* | 10/2024 | Brulz | B65D 33/01 |

FOREIGN PATENT DOCUMENTS

| | | | | |
|---|---|---|---|---|
| JP | 2004256120 | A | * | 9/2004 |
| JP | 2005255201 | A | * | 9/2005 |
| JP | 201423466 | | | 2/2014 |

* cited by examiner

RESEALABLE SUBSTANCE DISPENSING BAG

BACKGROUND OF THE INVENTION

This invention relates to the manufacture, structure and use of resealable bags that can be filled with material and equipped with outlets for dispensing the contents of the bag.

Resealable bags are commonly used for food storage, transportation of material, and display of material to consumers, although the present invention relates to any type of granular or liquid material. The manufacturing process for prefilled resealable bags is a multi-step process, commonly referred to as form-fill-seal. Machines such as vertical form-fill-seal (VFFS) machines are commonly used, though inclined or horizontal machines may also be appropriate. In other instances, bags can be partially formed and provided empty to material suppliers that can perform the filling and final sealing steps.

Polymer resin or polyethylene (such as low density polyethylene or LDPE) is a common film material used in creating resealable bags, but other materials can be chosen depending on the intended use of the bag. Thin, light, strong and flexible films (or webs) are preferred. The specific type of film used for a resealable bag depends on the intended end use of the bag and the properties required of the film. For example, a resealable bag intended for food packaging may require a film that is food-safe and has good barrier properties to prevent oxygen and moisture from entering or leaving the bag, while a resealable bag for other purposes such as driveway salt may require a film that is more durable and resistant to tearing.

The film to make resealable bags can be printed if desired, for instance with advertising, ingredients, instructions for use etc., and wound onto rolls for web processing. A continuous roll of the film is unwound from a film roll holder and fed into a forming section of the bag forming machine. In the forming section, a folded web of film (in the use of a single web system) or flat webs of film (in the use of a dual web system) are brought together and bonded to create the form of the nascent bag. Side seals, or fin seals, are created on two sides of the bag, and top and bottom seals can be created as well depending on the design and use of the bags. Different bag structures may be created, such as pillow bags, gusseted bags, and quad seal bags, as is well known in the art.

Stand up pouches (SUPs) are increasingly popular, and they are designed to stand upright on surfaces such as a cupboard or in a refrigerator, making it easier for consumers to handle and store. The stand-up feature is achieved by adding a gusset to the bottom of the pouch, which allows the pouch to expand and stand upright when it is filled, being self-supporting on its bottom surface.

If a resealable bag is desired, resealable zippers are coupled to one or more of the interior surfaces of the nascent bag. This is typically done using a machine that introduces the zipper between layers the film and seals the zipper in place using heat and pressure or ultrasonics.

The bag then can be prefilled with material in a variety of ways depending on the type of product and the desired level of automation. For instance, gravity filling may be used, in which the material is loaded into a hopper above the bag and allowed to flow by gravity into the bag below. The bag may held open by a filling spout or by vacuum suction cups as disclosed in U.S. Pat. No. 3,688,471 during this process. In an auger filling method, a rotating screw (auger) moves the material from a hopper and into the bag. The speed of the auger can be controlled to adjust the amount of material being dispensed. In a vibratory filling, method, the material is loaded into a vibrating tray that causes it to settle evenly into the bag. This method is often used for small or lightweight materials. Vacuum filling and pump filling techniques can also be used. In most instances, the prefilled material is metered, and material ingress to a bag is discontinued once a predetermined amount of material is contained in the bag.

After the zipper has been applied and the bag has been filled with product, the film may be cut into the desired size and shape using a cutting and/or sealing machine, and the bag may be further sealed along a selected edge used for filling. The film may sealed on two, three or four sides. If the zipper is within the seals of the bag structure, a user can remove one side of the bag (e.g., a top side), and then the consumer can access the contents of the bag through the resealable zipper exposed by removal of the chosen side of the bag. A removable sealed header can also be provided to create a temporary seal on the fourth side of the bag—near where the zipper exists—for the consumer to remove prior to use.

There are generally two types of closure mechanisms, a press-to-close system and a zip slider. In both, mating protrusions are coupled together on opposing sides of the closure mechanism on opposing internal sides of the bag to keep the bag sealed, and then the mating protrusions are decoupled to open the bag when desired. Examples of mating protrusions include a hook (generally referred to as male) and a hook track (generally referred to as female).

Filled bags are then transported to a point of sale, where they are displayed for purchase and use by consumers.

SUMMARY OF THE INVENTION

A resealable bag is produced with a series of apertures spanning first and second sidewalls of the bag, allowing egress of material from the bag. The apertures are integrated with a closure mechanism, preferably on the same web introduced into the resealable bag manufacturing process.

The material contained in and dispensed from the bag may be any material that is desired to be controllably dispensed from the bag, such as fluids or granular material including spices, seasonings, food products, fertilizer, seed, powders, salt, etc. Different sizes of pouches and different aperture sizes and configurations can be provided to accommodate preferred storage and dispensing of the selected material.

In one aspect of the invention, a closure mechanism for a bag structure for carrying at least one granule is disclosed, the closure mechanism comprising preferably a male and a female mating structure carried on a top side of a strip, and a plurality of discontinuous apertures formed in a middle section of the strip that occupies the mouth of a reclosable bag in use. The apertures are sized to controllably dispense the contents of the bag.

A larger aperture can be formed at one side of the bag mouth structure, with finer apertures formed at the other side of the mouth bag, to provide the user a choice between rapid and slower dispensing rates.

Advantages of the present invention over the prior art are reduced cost and storage space requirements. If spice jars are used to contain and dispense spices, it is estimated that it would take an entire truck to transport 30,000 spice jars, whereas 50,000 bags of the present invention could fit on a single pallet. Because spice jars are also considerably more expensive than bags of the present invention, the result is significant cost and space savings.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
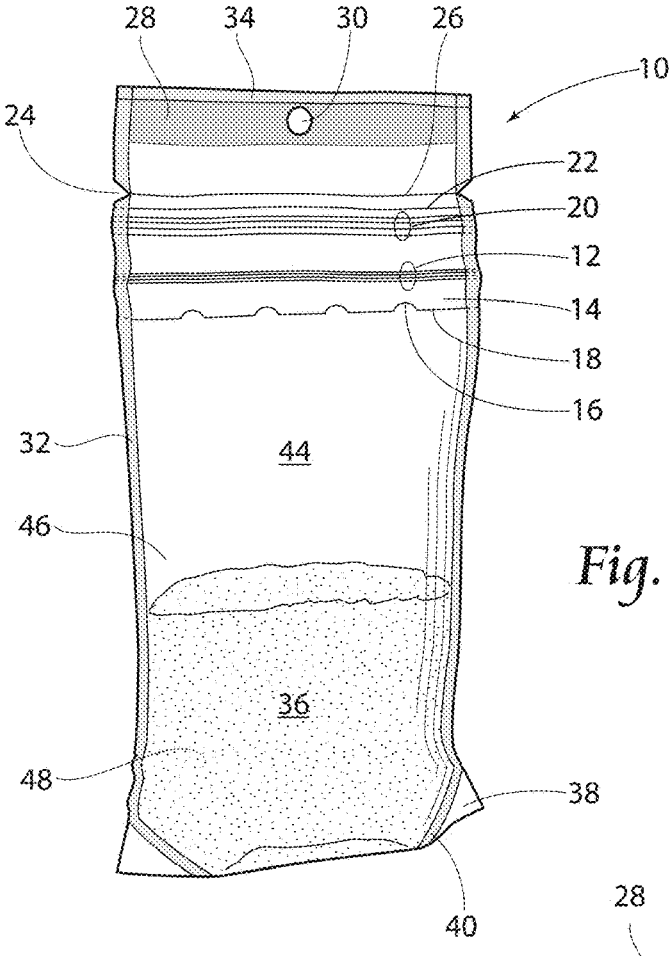
FIG. 1 is a perspective view of a closed, filled and sealed resealable bag of the present invention.
Figure 2:
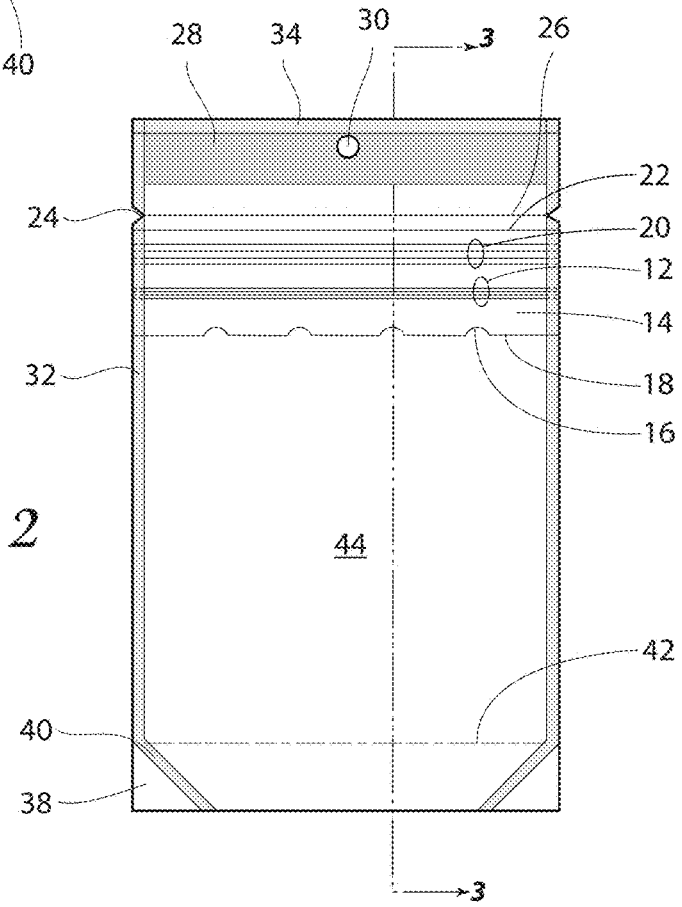
FIG. 2 is a plan view of a resealable bag.

Referring now to FIGS. 1 and 2, a perspective and a plan view, respectively, of a closed and sealed resealable bag 10 of the present invention are shown. In the illustrated and preferred embodiment, a gusseted stand up pouch (SUP) is provided. However, the substance dispensing resealable features of the present invention described below are applicable to other types of bag structures and not limited to SUPs or gusseted SUPs.

The resealable bag 10 is designed to hold material 36 in the bag interior 44. The present invention is particularly suited to dispense granular material, but other types of flowable materials may be held in the bag interior 44 and dispensed therefrom.

In a preferred embodiment, either two plies of material such as low density polyethylene (LDPE) film or a compostable web, or a single ply of those folded about itself, create a first bag wall 46 and a second bag wall 48. Side edges of the bag 10 can be sealed or bonded at side seams 32, joining first bag wall 46 with second bag wall 48. In a preferred embodiment, a gusseted bag 10 is created by providing corner seams 40 and gusset flaps 38. During formation of the bag 10, a gusset fold 42 is formed (see FIG. 2), such that when the bag 10 is stood up on a surface, the contents of the bag 10 urge the fold 42 open and widen the base of the bag 10, creating a stable platform on which bag 10 can stand.

Referring now to the top of the bag 10, optionally a top seam 34 and/or a sealed header zone 28 can be created by bonding first bag wall 46 with second bag wall 48. A hang hole 30 (or a handle) can be formed through a top portion of bag 10, such as through sealed header zone 28. Tear notches 24 can be provided through or into side seams 32 on one or both sides of bag 10 beneath the sealed header zone 28. A tear score 26 can be provided between tear notches 24 to facilitate partial opening of the bag 10 to expose closure structure 12 (of which there are preferably two, a first closure structure 12 and a second closure structure 12, see, e.g., FIG. 4B) of closure strip 14, by which bag 10 may be fully opened.

Closure strip 14 may contain several preferred features. A series of ridges 20 may be provided to act as a closure strip finger grip structure 20. Closure structure 12 provides the resealing function of bag 10, preferably using mating elements as described below in reference to FIGS. 3A and 3B. One or more closure apertures 16 are provided on closure strip 14 exposed to bag interior 44 and the contents thereof, material 36. A closure strip crease or fold 18 extends across the bag 10 at a region that closure strip 14 is folded over itself.

Figure 3A:
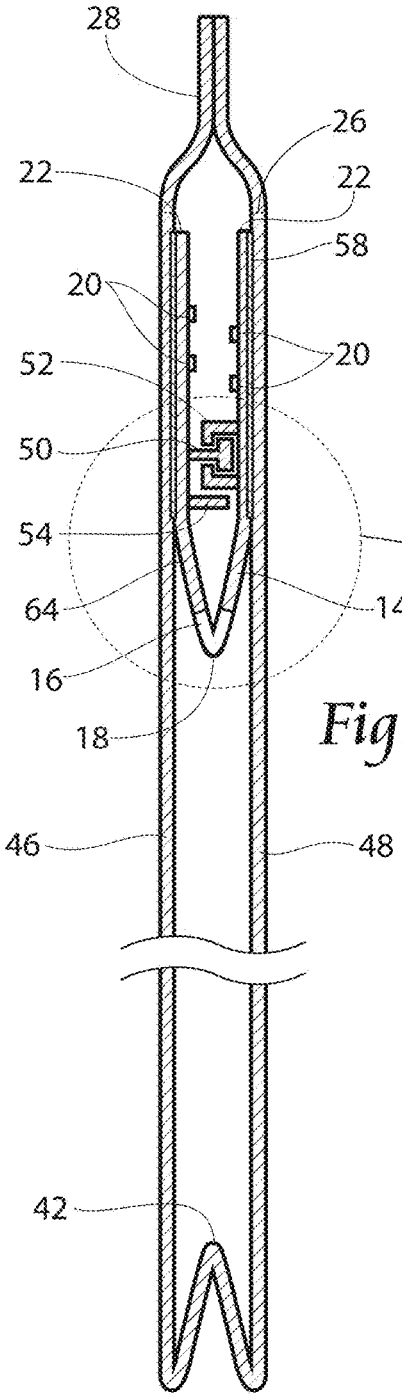
FIG. 3A is a cross-sectional view thereof.
Figure 3B:
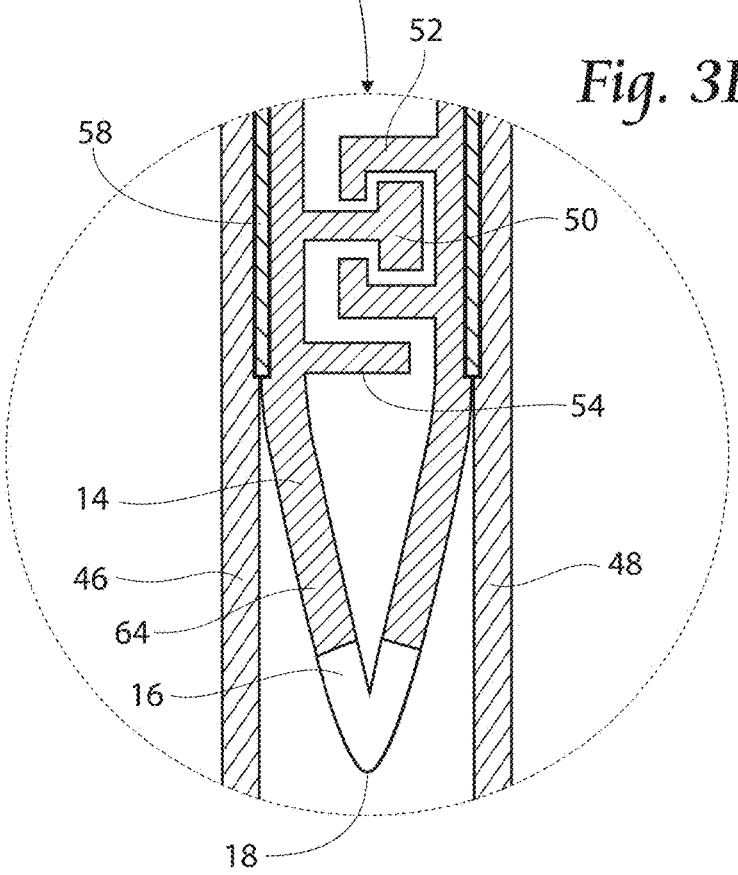
FIG. 3B is a close-up cross-sectional view of a portion of the bag of FIG. 3A.

Referring now to FIGS. 3A and 3B, a cross-sectional view of bag 10, with portions enlarged, is shown. At the top of the bag 10, sealed header zone 28 is formed by bonding first bag wall 46 with second bag wall 48. Moving lower in the bag 10, closure strip 14 is bonded to first bag wall 46 and second bag wall 48 at bonded region 58, preferably commencing the bonded region 58 at or below closure strip edge 22. Finger grip structures 20 are provided as ridges on closure strip 14, providing a surface for a user to grasp with their fingers while fully opening bag 10 by pulling apart and disengaging mating portions 50 and 52.

A male structure 50 extends inwardly from closure strip 14 adjacent to first bag wall 46, and to seal bag 10, the male structure 50 can be placed within female structure 52 extending from closure strip 14 adjacent second bag wall 48. Optionally, a zipper shield 54 can be provided beneath the male and female zipper structures 50 and 52 to minimize the contents of bag 10 from being exposed to, and possibly interfering with closure of the male and female zipper structures 50 and 52 if granular material becomes lodged in or to mating portions 50 and 52.

An unbonded region 64 of closure strip 14 extends between the bag first wall 46 and the second bag wall 48 between opposing bonded regions 58 on first bag wall 46 and second bag wall 48. Within this unbonded region 64 of closure strip 14, a closure aperture 16 or preferably a series of apertures 16 are provided.

Figure 4A:
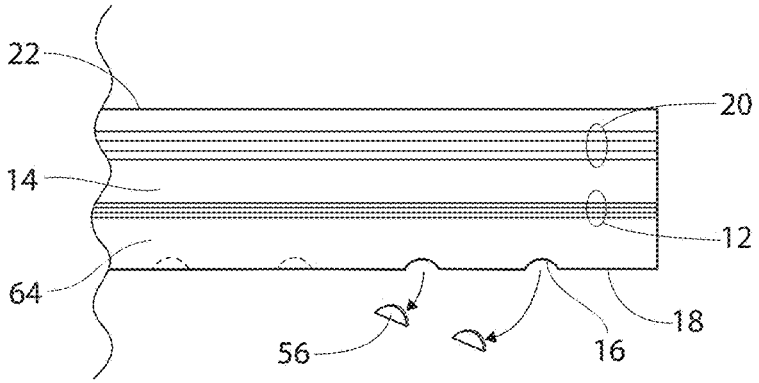
FIGS. 4A-4F are side or top views of different embodiments of a closure structure for a resealable bag.

Referring now to FIG. 4A, a side view of a closure strip 14 folded upon itself is shown. In this view, a closure strip edge 22 defines the top of closure strip 14, and a closure strip crease or fold 18 is at the bottom of closure strip 14, where the strip 14 has been folded upon itself lengthwise. In one method of forming closure strip 14, as the closure structure 12 comprising the male zipper structure 50 and the female zipper structure 52 is closed or closure strip 14 has been folded upon itself, chips 56 can be removed from near or through the closure strip crease 18, for instance by die cutting, punching, laser cutting or the like, as closure strip 14 advances in a machine direction. Chips 56 are not necessarily formed through closure strip crease 18, but can also be removed in any region of closure strip 14 between opposing closure structures 12, or between closure structures 12 and closure strip crease 18.

Figure 4B:
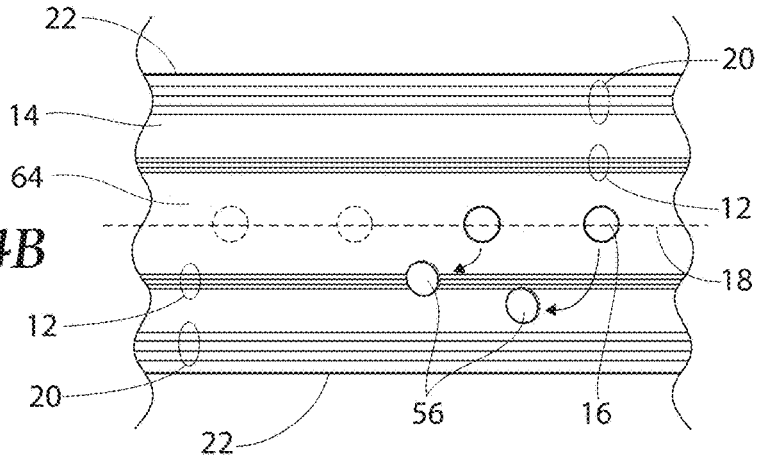

Referring now to FIG. 4B, closure apertures 16 can also be created as closure strip 14 lays flat open. Unbonded region 64 can be of any dimension, but it is preferable that unbonded region 64 span between closure elements 12 (which are preferably male and female zipper structures 50 and 52).

Figure 4C:
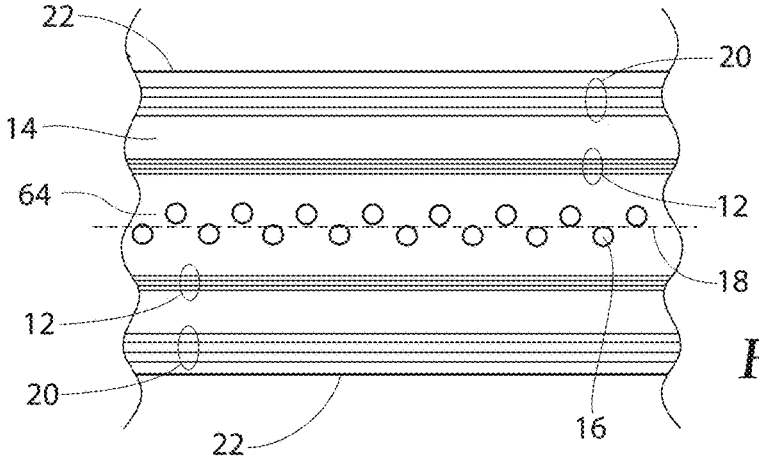
Figure 4D:
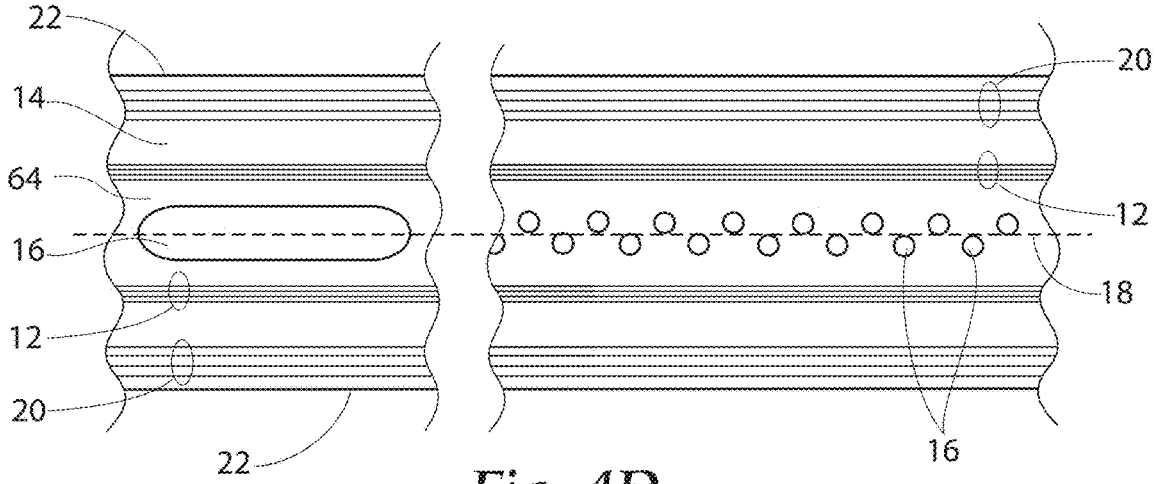

Referring now to FIGS. 4C-4F, several variations and configurations of closure apertures 16 are possible. As shown in FIG. 4C, closure apertures 16 can alternate vertically, or as shown in FIG. 4D, an enlarged aperture 16

(having a first area) can be provided along closure strip 14, and optionally with smaller apertures 16 (having a second area).

Figure 4E:
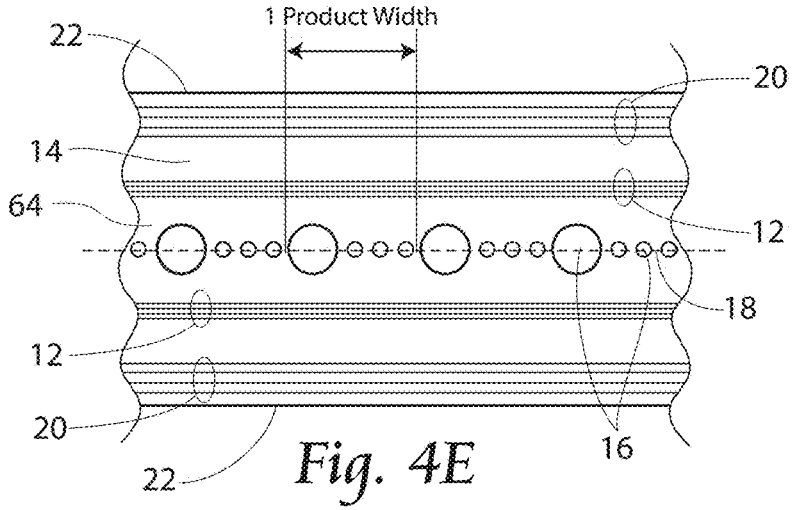

As shown in FIG. 4E, large closure aperture 16 can alternate lengthwise with a series of smaller closure apertures 16 at a 1 product width interval. In this embodiment, during construction of bag 10, the closure strip 14 could be registered so that a larger closure aperture 16 is be provided proximally to a first edge of bag 10 at a first distance (proximal) to that edge, for instance to allow a greater rate of material 36 to exit the bag 10 during use if bag 10 is inverted and tipped toward the larger closure aperture 16. The smaller apertures 16 could be provided at the other edge of bag 10 (e.g., at a second distance from the first edge of the bag), to provide for a more controlled and measured rate of dispensing material 36 from bag 10 if bag 10 is inverted and tipped toward the smaller closure apertures 16.

Figure 4F:
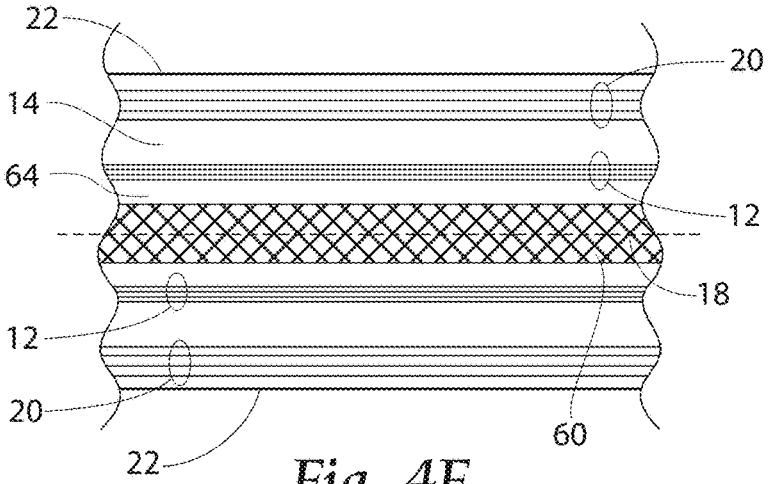

Referring now to FIG. 4F, other patterns, such as a mesh pattern 60 can be formed in closure strip 14 by creating a multitude of apertures. In addition to the punching or die cutting methods of forming closure apertures 16 described above, closure strip 14 could also be formed by introducing an intermediate web of apertured material, such as an independent web of mesh 60 placed between lengthwise webs of closure elements 12.

Figure 5:
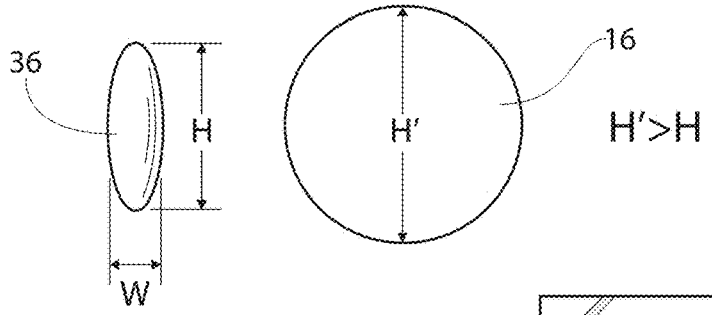
FIG. 5 is a side-by-side comparison of exemplary grain size and exemplary closure aperture size.

Referring now to FIG. 5, a side view comparison of exemplary grain size and exemplary closure aperture 16 size is shown. In one embodiment, material 36 is granular. Granular material 36 can have a maximum height dimension H and a maximum width dimension W. Aperture 16 can be formed with height H' and in a preferred embodiment, H' is greater than H. However, H' need only be greater than width W to allow passage of material 36 through aperture 16.

Figure 6:
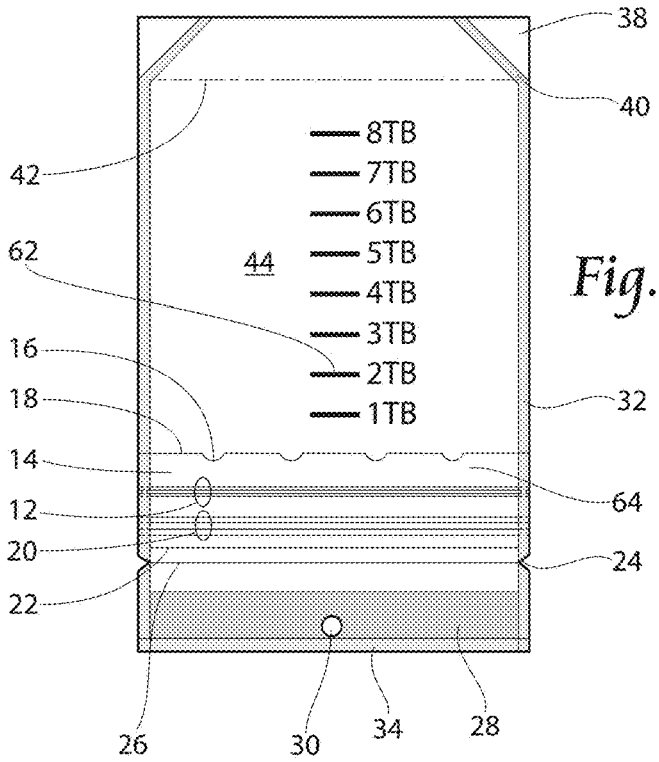
FIG. 6 is a side view of a closed and sealed resealable bag upside down, showing optional material measurement markers.

Referring now to FIG. 6, a side view of a closed and sealed resealable bag 10 upside down is shown. In one embodiment of the present invention, material measurement markers 62 can be printed on bag 10, preferably upside down, so that when bag 10 is placed upside down to disperse material 36, the amount of material 36 dispersed can be measured. This feature would be especially useful, for instance, if a recipe called for a certain quantity of granular material 36, and is especially useful if the bag 10 is produced at least in part with clear material so that the amount of material 36 in the bag can be ascertained.

Figure 7A:
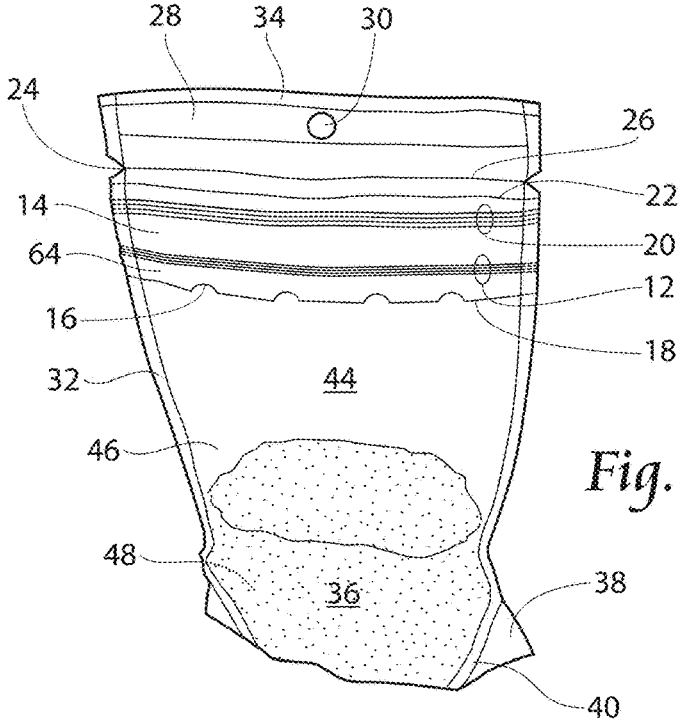
FIGS. 7A-7D are a perspective in-use sequence showing use of the resealable bag.
Figure 7B:
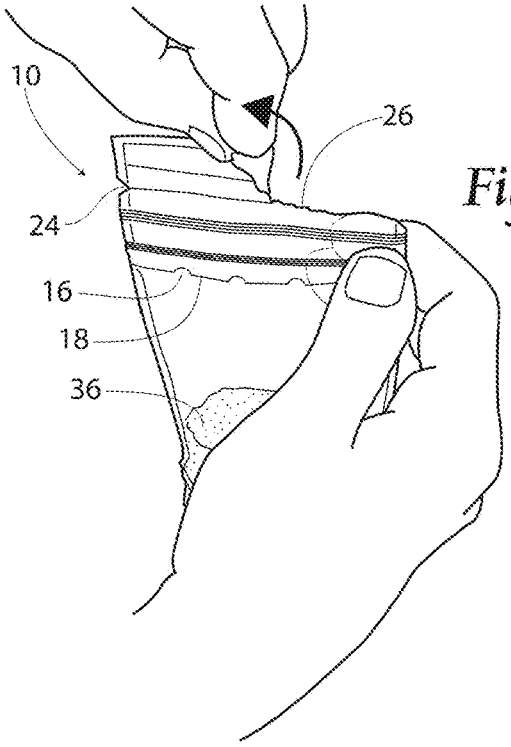
Figure 7C:
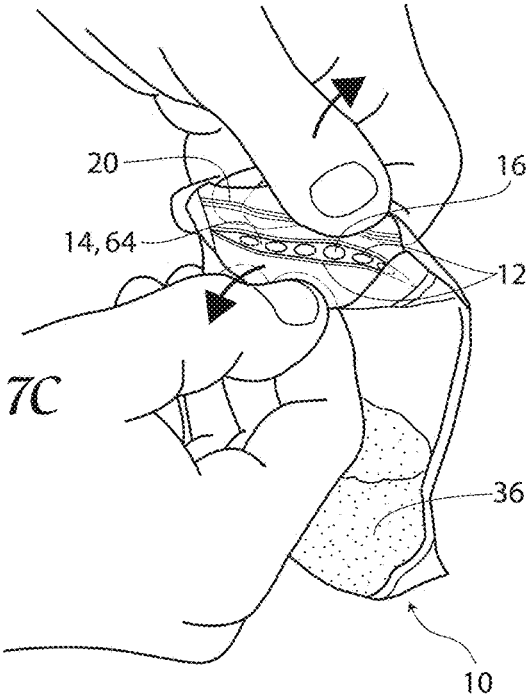
Figure 7D:
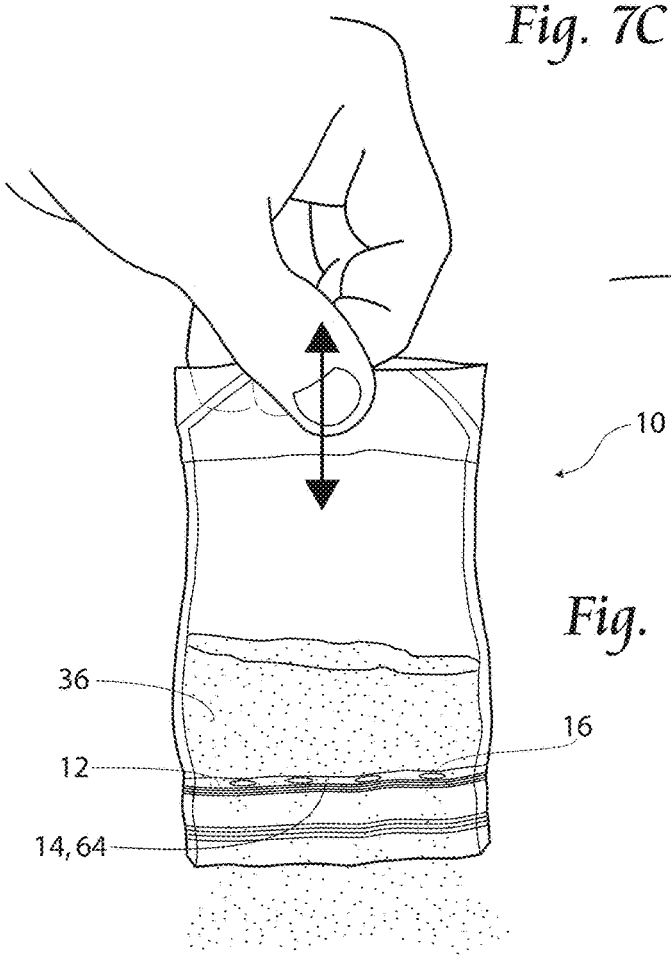

FIGS. 7A-7D are a perspective in-use sequence showing use of the resealable bag 10. Referring first to FIG. 7A, a sealed, closed, and filled bag 10 is provided containing material 36 in the bag interior 44. Referring now to FIG. 7B, first, a user grasps bag 10 either at sealed header zone 28 or near or just above tear notch 24. Next, the user pulls along tear score 26. Following this tearing, as shown in FIG. 7C, a user can grasp finger grip structures 20 and pull apart the first wall 46 and the second wall 48 of bag 10 while simultaneously disengaging male structure 50 and female structure 52 of the closure structure 12. This exposes closure apertures 16, while unbonded portion 64 of closure strip 14 spans the now opened mouth of bag 10. As shown in FIG. 7D, a user can then invert bag 10 to dispense material 36 from bag 10. Shaking bag 10 while bag 10 is inverted can assist in dispensing material 36 from bag 10. Dispensing rate of material 36 is controlled by the size of apertures 16, as the unbonded region 64 of closure strip 14 partially retains material 36 in bag 10 in portions of the unbonded region 64 without voids. Following dispensing of the desired amount of material 36, a user can then place bag 10 upright and rejoin male structure 50 and female structure 52 of the closure structure 12, either by pressing them together from outside first wall 46 and the second wall 48, or by using a slider closure mechanism (not shown). The bag 10 can then be stored until the next use.

In other embodiments, closure structure 14 and its constituent elements can be placed at a bottom or a side of bag 10 (not shown).

To form bag 10 (not shown) a first film or material web is provided (or two webs are provided in parallel) to form first and second walls 46 and 48. A bottom gusset is formed by folding gusset fold 42, and bonding a plurality of corner seams 40. Separately, a continuous closure strip 14 and the elements of FIGS. 4A-4F are created for instance, by extrusion and apertures 16 are then created in closure strip 14, either while folded or laid out flat. Closure strip 14 is introduced in a folded condition between first and second walls 46 and 48. Side seams 32 are then bonded, bonding first and second bag walls 46 and 48.

In in one embodiment, only one of bag walls 46 and 48 are bonded to closure strip 14 on an interior surface of the selected bag wall 46 of 48. At this point, bags 10 can be shipped out to a customer for filling and final sealing. Material 36 can be introduced into bag interior 44 through bag walls 46 and 48, through and between closure strip 14 and the unbonded wall 46 or 48. Next, tear notch 24 and tear score 26 can be formed on bag 10. Header zone 28 and top seam 34 can also be created by bonding walls 46 and 48, and hang hole or handle 30 can be formed in header zone 28.

In another embodiment, material 36 can be introduced into bag interior 44 prior to introducing closure strip 14 into the process, or prior to bonding closure strip 14 to one or both bag walls 46 and 48. Next, closure strip 14 can be bonded to bag walls 46 and 48, and tear notch 24 and tear score 26 can be formed on bag 10. Header zone 28 and top seam 34 can also be created by bonding walls 46 and 48, and hang hole or handle 30 can be formed in header zone 28.

Following these steps, sealed and closed resealable bags 10 containing material 36 are prepared for shipping, display, purchase, and use.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

The invention claimed is:

1. A closure mechanism for a bag structure for carrying at least one granule, said closure mechanism comprising:

a first closure structure carried on a top side of a strip comprising a top side and a bottom side;

a second closure structure carried on said top side of said strip;

a plurality of discontinuous apertures in said strip between said first closure structure and said second closure structure, said discontinuous apertures having a greatest dimension greater than a smallest dimension of said at least one granule;

at least one of said plurality of discontinuous apertures configured to pass said at least one granule from said bottom side of said strip to said top side of said strip;

a first bag wall and a second bag wall;

a first bonded region coupling a first portion of said bottom side of said strip to said first bag wall;

a second bonded region opposing said first bonded region, said second bonded region coupling a second portion of said bottom side of said strip to said second bag wall.

2. A closure mechanism according to claim 1, said closure mechanism further comprising a first of said plurality of discontinuous apertures having a first area, and a second of said plurality of discontinuous apertures having a second area, said first area greater than said second area.

3. A closure mechanism according to claim 2, said first of said plurality of discontinuous apertures having said first area positioned at a first distance to a first edge of said bag structure, and said second of said plurality of discontinuous apertures having said second area positioned at a second distance to said first edge of said bag structure, said second distance greater than said first distance.

4. A closure mechanism according to claim 1, said bottom side of said strip bonded to a first interior surface of said bag structure and said bottom side of said strip bonded to a second interior surface of said bag structure, said plurality of discontinuous apertures between said first interior surface of said bag structure and said second interior surface of said bag structure in an unbonded region of said strip between said first interior surface of said bag structure and said second interior surface of said bag structure.

5. A closure mechanism according to claim 1, wherein said greatest dimension of said plurality of discontinuous apertures is greater than a greatest dimension of said at least one granule.

6. A closure mechanism according to claim 1, wherein said discontinuous apertures are formed while said strip is in a folded configuration.

7. A closure mechanism according to claim 1, wherein said discontinuous apertures are formed while said strip is in a flat configuration.

8. A resealable bag for carrying a plurality of granules, said resealable bag comprising:

a first sidewall and a second sidewall;

a strip comprising a top side and a bottom side;

a closure mechanism comprising a first closure structure and a second closure structure, said first closure structure and said second closure structure carried by said top side of said strip;

a first portion of said bottom side of said strip coupled to said first sidewall at a first bonded region;

a second portion of said bottom side of said strip coupled to said second sidewall at a second bonded region opposing said first bonded region;

a third portion of said strip between said first sidewall and said second sidewall, said third portion of said strip unbonded to said first sidewall and unbonded to said second sidewall;

an aperture through said third portion of said strip;

said aperture having a greatest dimension greater than a smallest dimension of said granules;

said aperture configured to pass said granules from said bottom side of said strip to said top side of said strip.

9. A resealable bag according to claim 8, said first sidewall and said second sidewall bonded together in at least two locations to form a first side seam and a second side seam.

10. A resealable bag according to claim 8, said strip coupled to said first sidewall before placing said granules within said resealable bag, and said strip coupled to said second sidewall after placing said granules within said resealable bag.

11. A resealable bag according to claim 8, said closure mechanism extending across a width of said resealable bag at first distance from a bottom of said resealable bag, a fourth portion of said strip extending from said closure mechanism to a second distance from said bottom of said resealable bag, said second distance greater than said first distance, said fourth region unbonded to said first sidewall and said second sidewall.

12. A resealable bag according to claim 8, wherein said greatest dimension of said aperture is greater than a greatest dimension of one of said granules.

13. A resealable bag according to claim 8, said aperture formed at a crease in said third portion of said strip.

14. A resealable bag according to claim 8, said resealable bag further comprising a series of apertures formed in said third portion of said strip, said series of apertures, said series of apertures formed across a crease of said third portion of said strip.

15. A resealable bag according to claim 8, said resealable bag further comprising a series of apertures formed symmetrically in said third portion of said strip with respect to a crease of said third portion of said strip.

16. A resealable bag according to claim 8, said resealable bag further comprising a series of apertures formed asymmetrically in said third portion of said strip with respect to a crease of said third portion of said strip.

17. A resealable bag according to claim 8, wherein said aperture is formed while said strip is in a folded configuration.

18. A resealable bag according to claim 8, wherein said aperture is formed while said strip is in a flat configuration.

19. A closure mechanism for a bag structure for carrying at least one granule, said closure mechanism comprising:

a first closure structure carried on a top side of a strip comprising a top side and a bottom side;

a second closure structure carried on said top side of said strip;

a plurality of discontinuous apertures in said strip between said first closure structure and said second closure structure, said discontinuous apertures having a greatest dimension greater than a smallest dimension of said at least one granule;

at least one of said plurality of discontinuous apertures configured to pass said at least one granule from said bottom side of said strip to said top side of said strip;

a first bag wall and a second bag wall;

a first bonded region coupling a first portion of said bottom side of said strip to said first bag wall;

a second bonded region coupling a second portion of said bottom side of said strip to said second bag wall;

a third bonded region bonding said first bag wall to said second bag wall in the absence of said strip.

* * * * *